US005689848A

United States Patent [19]

Saal et al.

[11] Patent Number: 5,689,848

[45] Date of Patent: Nov. 25, 1997

[54] METHOD AND APPARATUS FOR DRY CLEANING TEXTILES

[75] Inventors: Hans-Udo Saal; Ralf Mathias Saal, both of Bad Honnef, Germany

[73] Assignee: SATEC GmbH, Reinbreitbach, Germany

[21] Appl. No.: 726,383

[22] Filed: Oct. 4, 1996

[30] Foreign Application Priority Data

Nov. 5, 1995 [EP] European Pat. Off. ..... 95115725
Nov. 7, 1995 [EP] European Pat. Off. ..... 95117536

[51] Int. Cl.[6] ..... D06B 23/20

[52] U.S. Cl. ..... 8/159; 34/131; 34/495; 34/493; 34/467; 68/12.08; 68/58

[58] Field of Search ..... 34/130, 131, 72, 34/78, 77, 447, 467, 493, 495, 496; 8/159, 158, 493; 68/18 C, 12.02, 12.08, 12.09, 58

[56] References Cited

U.S. PATENT DOCUMENTS 3,529,358 9/1970 Robinson ..... 34/496
4,811,495 3/1989 Huang et al. ..... 34/131
5,347,726 9/1994 Kim ..... 34/495
5,555,641 9/1996 Lee ..... 34/495
5,619,614 4/1997 Payne et al. ..... 34/495

*Primary Examiner*—Frankie L. Stinson
*Attorney, Agent, or Firm*—George W. Dishong

[57] ABSTRACT

The invention relates to a method of dry cleaning textiles which are washed with solvent and dried by hot air, the solvent being recovered after condensation, the invention being characterised in that the solvent concentration is measured at the point where it is highest and temperature is measured, both being measured continuously throughout the whole of the drying process and the values are processed in a computer, and the concentration in the supply of hot air is controlled as a function of the relationship of concentration, acting as the pilot value, to temperature along a characteristic.

20 Claims, 2 Drawing Sheets

METHOD AND APPARATUS FOR DRY CLEANING TEXTILES

Figure 1:
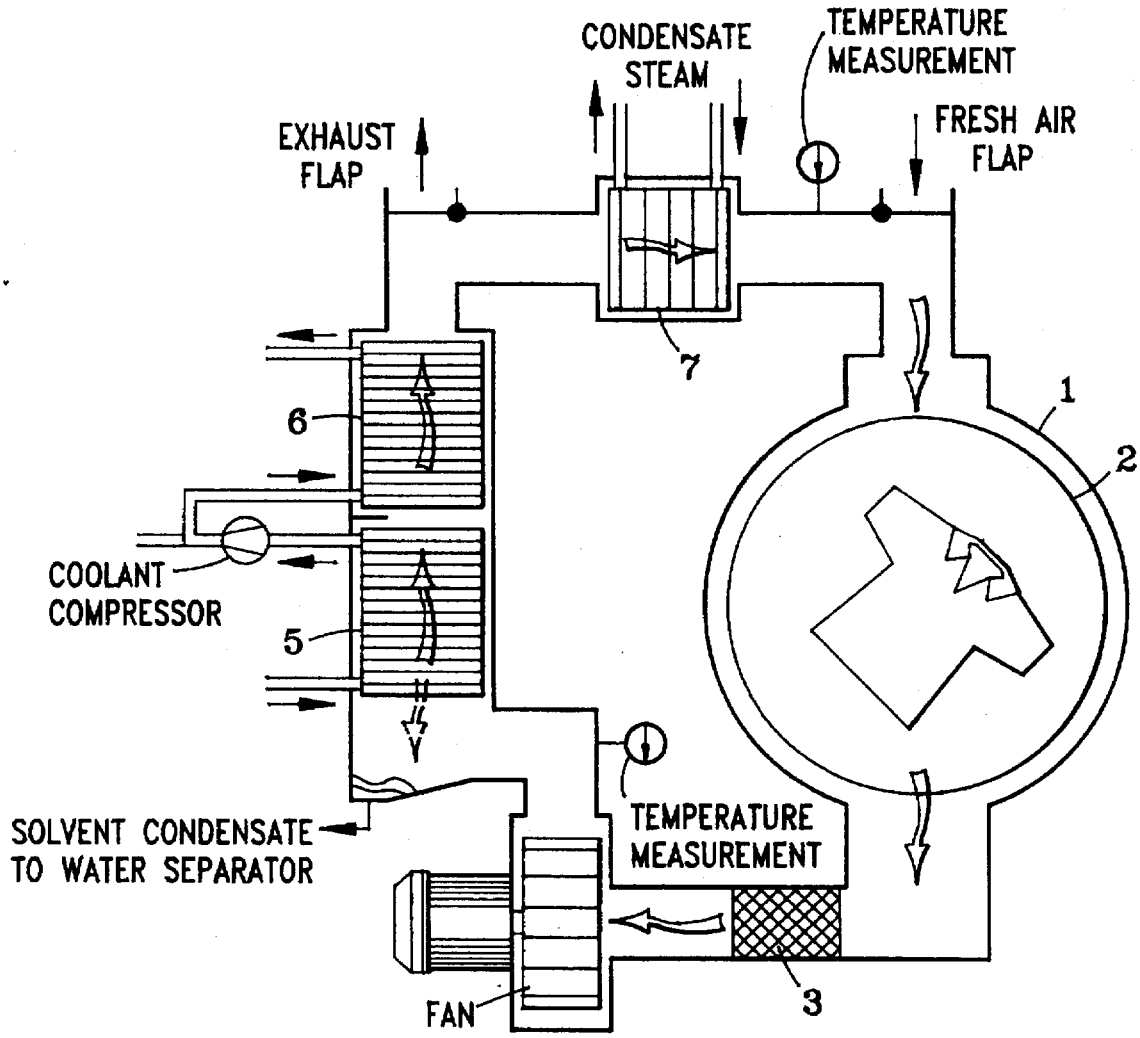

The invention relates to a method of dry cleaning textiles which are washed with solvent and dried by hot air, the solvent being recovered after condensation.

The invention also relates to an apparatus of this kind having a washing and drying cylinder, a condenser for the solvent, a heating system and supply of hot air for drying, it being possible for washing and drying to take place in the same machine or alternatively in two separate machines.

With the ban on HCFCs and the sharp decline in the public acceptance of per(tetra)chloroethylene, dry cleaning systems intended for hydrocarbon solvents, i.e. very largely aroma-free solvents which are members of the alkane group, are becoming increasingly important. The flash point of these solvents is above 55° C.

Dry cleaning machines operate as a closed system and are responsible not only for cleaning goods but also for drying them, at the same time as they recover the solvent employed by condensing and regenerating it (distillation, adsorption).

The use of flammable hydrocarbon solvents with their low vapour pressures and high boiling ranges has created new requirements which the drying process needs to meet with regard to optimum fire safety conditions, to drying times, to the use of energy and to the environment.

Drying in dry cleaning systems is affected by a large number of varying conditions: these are the nature and quantity of the goods to be cleaned and the amount of residual solvent left in them after spin drying, the physical properties of the solvent used, the thermal energy applied and the volume flow of the recirculated air. These conditions vary from one load to the next.

Hitherto the drying process in dry cleaning systems has been controlled by time and the temperature of the recirculated air using empirical values which the machine operator presets at his own discretion. The consequences of controlling the process in this way are either:

- overdrying of the goods due to excessively long drying times, resulting in possible damage to the goods, excessive energy consumption and a reduction in the machine's handling capacity, or
- insufficient drying due to excessively short drying times, with the result that the goods are not dried sufficiently well and the residual solvent gives rise to additional emissions and may, under certain circumstances if in contact with the skin for fairly long periods, cause skin irritation. This problem is of particular concern from the environmental and health points of view because what tends to be found in practice, due to inadequate measuring techniques and economic considerations, is underdrying rather than overdrying.

Also, with flammable solvents, there may be conditions in which the concentration in the recirculated air in the drying system rises above the lower explosive limit. To avoid fires or explosions, primary safety measures of the following kind are therefore taken:

- reducing the $O_2$ content of the recirculated air in the dryer to well below 11%, either by injecting an inert gas (e.g. $N_2$) or by generating a partial vacuum, or
- restricting the drying temperature to values appreciably below the flash point.

The first variant involves considerable additional expense and complication in terms of machinery and energy, while in the second drying takes place more slowly, i.e. the drying times are longer and the machine's handling capacity goes down. In both cases however the safety-related parameters are easily measurable ($O_2$ or temperature).

A third means of achieving safety consists in keeping the solvent concentration in a non-critical range, i.e. below the lower explosive limit, in all the phases of the drying process. By so doing it would be possible to avoid on the one hand the machine costs involved in reducing the $O_2$ content and on the other the disadvantages of a reduction in temperature. However, a prerequisite for this is that the solvent concentration should be continuously measurable and that it should be controllable under all conditions by process technology.

However, with all the measurement procedures which might be considered (FID, PID, IR, GC), what has so far frustrated any attempt reliably to measure and monitor solvent concentration under the conditions that exist during drying has been the condensation that occurs specifically in the measuring systems, caused by temperature being brought below the dew point. As a result it has not been possible to observe or act on the processes taking place and the drying process has necessarily had to be controlled empirically.

The object of the invention on the other hand is to avoid on the one hand the cost and complication thought necessary in the past, i.e. the reduction in the $O_2$ content of the recirculated air in the dryer or the slower drying, and, on the other, the condensation in the measuring system, and to propose a particularly inexpensive method.

In accordance with the invention, this is achieved in a method of the kind described above by measuring solvent concentration, at the point where it is highest, and temperature, and doing so continuously throughout the whole of the drying process, by processing the values in a computer, and by controlling the concentration in the supply of hot air as a function of the relationship between concentration, acting as the pilot value, and temperature along a characteristic. The factor preferably adopted for the characteristic is the increase in concentration per unit of time.

After a steep rise, operation is directed in accordance with the invention towards achieving a plateau of concentration.

It is advantageous for heat to be fed in intermittently to avoid any increase to excessively high solvent concentrations.

It has been found particular advantageous, and this prevents all the problems caused by condensation, for the measurement sensor to be heated.

At the changeover to the next phase (the cool-down phase), there is a wait until the concentration is at least 90% below whatever is the maximum concentration in the particular case.

It is advantageous for use to be made of an infrared (IR) concentration measuring device directly at the exit from the drying cylinder and for it to be used to obtain a continuous measurement of concentration, which was not available previously, this being done up to the end of drying.

A fuzzy logic control system has been found particularly advantageous for this purpose.

Hence, what is obtained is a pilot controlled drying process intended for dry cleaning systems using hydrocarbon solvents. It is of course possible for the process to be applied to systems using perchloroethylene, though in this case the question of safety (the risk of explosion) and the measures it calls for can be disregarded.

Hence a reliable measuring technique has been developed and has been adapted to suit the object to be achieved, this technique allowing continuous measurement of concentration throughout the entire drying process. Factors which influence the drying process have been investigated as also has the effect which disruptive factors have on drying. Controlling variables for the drying process have been established. The measures claimed for the invention have made it possible for suitable software to be developed to allow the measurement signals to be converted by process techniques into control signals. By the measures according to the invention it has been possible for solvent concentrations within the range of a maximum of 75% of the lower explosive limit to be ensured under all planned and unplanned process conditions.

Hence, there is installed at the exit from the cylinder, the region in which concentration is at its highest, a measuring unit of modified design (modified for example by having a heated measuring channel) which will reliably prevent the condensation phenomena which occurred hitherto. In this way it becomes possible for concentration to be measured continuously from the beginning of drying to the end. The measurement signals are fed to the computerised controller internal to the machine (a programmable logic controller =PLC). The operation of the IR measuring unit is checked automatically by means of a self-check function. In the PLC the signals are processed with the help of the process-related factors which have been determined to be influencing factors and control signals are fed to the systems of the machine (such as signals for the supply of steam, to control the fan motor, drum drive, door lock, or ventilation flaps, to control the valves in the cooling systems, and so on).

In this way and in contrast to the conventional procedure, the computerised controller becomes responsible for setting the optimum drying and cool-down times as a function of the curve followed by the concentration in the cylinder.

The effects achieved are as follows:

The concentration curve becomes considerably flatter, through by first rising to a plateau in this case.

When the preset limit of 70% of the lower explosion limit is reached, the supply of heat is stopped immediately. As a result, the concentration drops again.

The supply of heat is maintained for as long as there is clear evidence of the concentration dropping towards a preset threshold.

By making use of the latent heat still present in the dryer, a further drop in concentration is obtained in the cool-down phase. Once concentration has dropped to below the limit represented by 10% of the lower explosive limit, cool-down is brought to an end and the venting process initiated.

Despite a clear reduction in the peak concentration, the overall length of the drying process is reduced by up to 25%.

The results are as follows:

The inert gas injection or vacuum generation otherwise needed for safety purposes can be dispensed with, thus saving on costs and improving reliability in practical operation.

Drying time is optimum under the most widely varying conditions. Hence it can be reduced by 20% on average and the handling capacity of the dry cleaning system rises accordingly by 20%.

Wastage of heat due to overdrying is avoided. Taken together, the reduction in drying time, the saving on heat and the absence of the generally used inert gas injection result in energy savings of approximately 160 Wh per kg of goods dried (approx. 40%).

Underdrying of the goods and the related emission of solvents into the environment and health risks can be reliably avoided. This advantage is non-quantifiable but it is of special significance for environmental and health reasons.

The residual level permitted under European guidelines is 350 ppm. The level achieved in accordance with the invention is 99% below this limit.

A changeover from the cool-down phase to the venting phase takes place when the change in the decline in concentration over time, which, after the plateau is reached, first becomes shallow and then very shallow, reaches a certain, very low, level.

The fuzzy logic sets an ideal drying curve and the fuzzy logic controller then makes a comparison between temperature and concentration and selects a concentration curve over time which allows for influencing factors such as overloaded or underloaded cylinders, heavy textiles which the solvents find it harder to escape from, and light textiles from which it is easier for them to escape. Once the controller has decided on a particular concentration curve, a specific pilot value is calculated for this curve as a function of concentration and temperature. An important factor here is that, because the media involved are nonpolar, electrical measurements are not possible.

Figure 2:
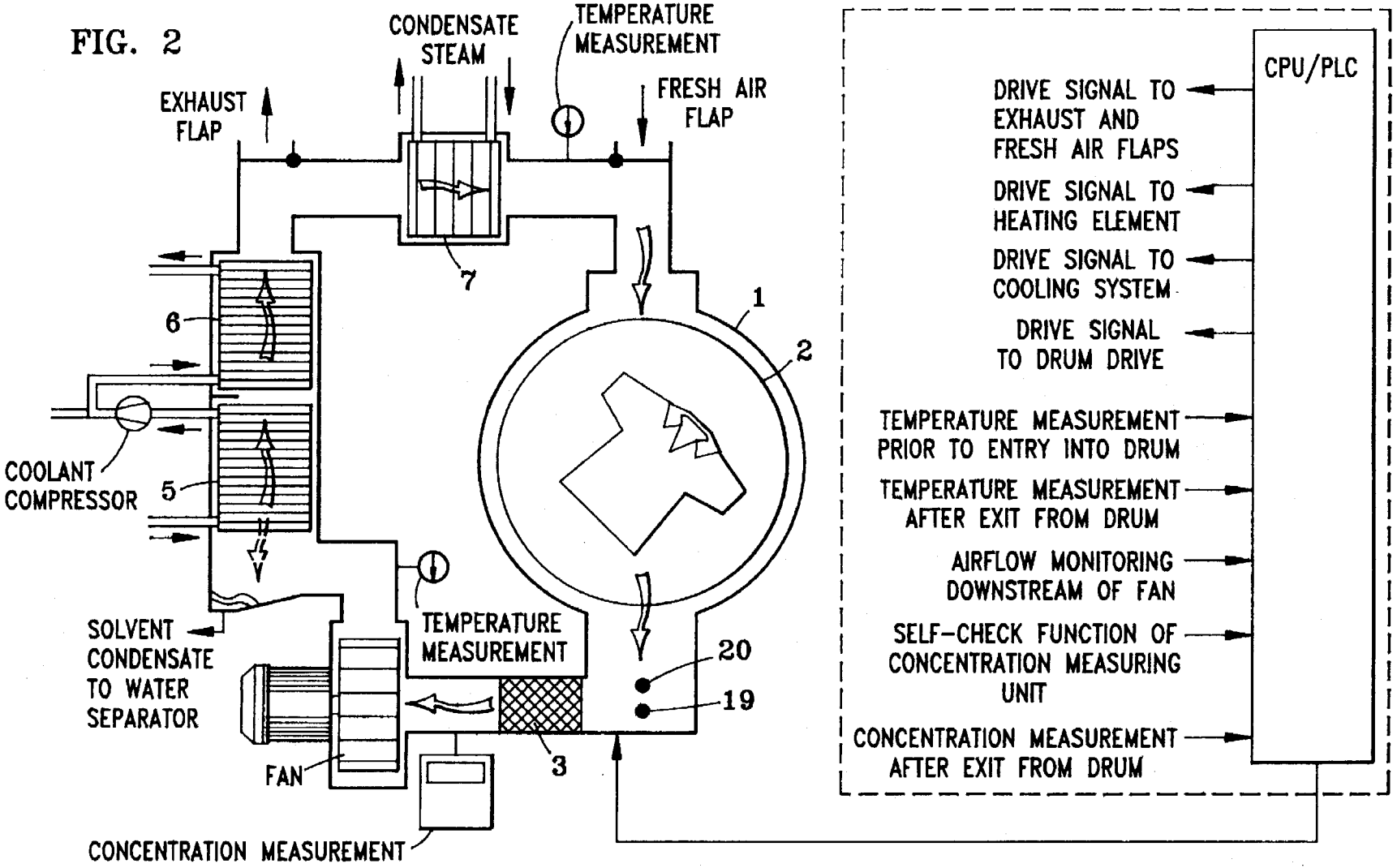

Illustrative embodiments of the invention will now be described in greater detail by reference to the accompanying drawings, in which:

FIG. 1 is a diagram of drying without the pilot control according to the invention, FIG. 2 is a similar diagram of drying but with the pilot control according to the invention.

At the end of the cleaning process, after the pumping of the unabsorbed solvent bath out of the cylinder and the subsequent spin-drying, the drying phase proper begins (phase I). Laid down in the program as a function of the nature and sensitivity of the goods are the maximum permitted temperature for the recirculated air during drying, the drying time, the temperature in the cool-down phase (phase II) and the time allowed for venting (phase III).

The air, having been preheated in preheater 6 and raised to the preset desired temperature in heating element 7, flows through the outer drum and inner drum 1, 2 and as it does so picks up solvent from the cleaned goods. On leaving the outer drum 1, the solvent-laden air first flows through a lint filter 3, in which the abraded lint is filtered out, and from there to a solvent condenser 5 in which the solvent and water fractions are condensed on cooled surfaces. The solvent/water mixture passes through a water separator and the solvent goes to a solvent tank where it is again available for cleaning. In the refrigerant condenser of the cooling unit, i.e. preheater 6, the cooled, unladen air re-absorbs a proportion of the heat previously withdrawn from it and then passes through heating element 7, which is heated by steam or electricity, and back to the inner and outer drums 1, 2. Phase I is brought to an end automatically after the preset time expires and phase II (cool-down) is then initiated. In the case being described it cannot be determined whether phase I may not have been too long or too short—this can only be established when the goods are unloaded.

In the cool-down process, the goods are gradually cooled in the cylinder and any residual solvent that may still be present is removed. For this purpose the supply of heat from the cooling unit (preheater) and the supply of steam to the heating element are shut off. The phase is brought to an end when the preset temperature (<50° C.) is reached. After the cool-down phase (in phase III) the dryer is vented under timed control (for approx. 1 minute). For this the closed air circuit is opened, i.e. ambient air is drawn in and after flowing through the dryer is returned to free atmosphere.

Hence, what takes place in the prior art is that:

temperature is measured before entry to the inner and outer drums, temperature is measured again on exit from the inner and outer drums, finally, airflow is monitored downstream of the fan, the exhaust and fresh-air flaps are driven as a function of the measurements made, the heating element is driven, the cooling system is driven and, finally, the drum drive is also driven.

FIG. 2 shows the essential changes which, in accordance with the invention, produce a surprising result. The same parts are identified by the same reference numerals. The path followed by the recirculated air in the drying phase is substantially the same in the two cases. When, in the case of the method according to the invention, the signals obtained from the central processing unit after processing in the PLC are significant, the components of the machine are driven in a totally different way and the working of the process, especially with regard to measurement, is arranged entirely differently.

Temperature is measured before entry to the inner and outer drums. Temperature is measured at 19 immediately on exit from the inner and outer drums. Concentration is measured at 20 immediately on exit from the inner and outer drums.

A self-check function for the concentration measuring unit is active and airflow is measured downstream of the fan. To prevent the condensation phenomena which had to be accepted hitherto, the condensation measuring unit, and in particular its measuring channel, is heated. The concentration measuring unit positioned directly on the passage through the inner and outer drums ½ must be installed in the region where concentration is at its highest and it takes the modified form of an infrared (IR) measuring unit. For the first time, the concentration measuring unit 20 makes it possible for concentration to be measured continuously from the beginning of drying to the end. The measurement signals from it are fed to the computerised controller internal to the machine (the PLC associated with the CPU). Self-check functions allow the operation of the IR measuring unit to be checked automatically and thus the control applied to be reliable and switch-off operations to be undertaken if necessary, in any conceivable process condition. The measurement signals which are sensed are processed in the PLC (five input signals are shown in the drawing). Control signals are fed to the machine system with reference to the process-related factors which have been determined to be influencing factors.

In contrast to the prior art shown in FIG. 1, the computerised control system (CPU/PLC) is responsible for setting the optimum drying and cool-down times as a function of the curve followed by the concentration in the inner and outer drums ½, which is measured by means of 20 in relation to 19 (temperature measurement).

In the prior art, drying was set and run from empirically determined values and depended on the skill of the person in charge. Because of the danger of overheating textiles, it often had to be accepted that they would contain residual amounts of solvent.

We claim:

1. Method for dry cleaning textiles comprising the steps of:

washing said textiles with a solvent;

drying said textiles using hot air;

continuously measuring throughout the whole of said drying of said textiles, a concentration level of said solvent;

measuring continuously throughout the whole of said drying of said textiles, a temperature of said drying hot air;

processing in a computer said measured concentration level of said solvent and said measured temperature of said drying hot air;

continuously controlling throughout the whole of said drying of said textiles, based upon said computer processing of said concentration level and said temperature, said temperature level of said drying hot air, said continuous controlling being a function of a relationship between said concentration level, acting as a pilot value, and temperature along a characteristic and to be not more than a predetermined highest temperature;

controlling continuously throughout the whole of said drying of said textiles said concentration level of said solvent, said controlling continuously being a function of said relationship between said concentration level, acting as said pilot value, and said temperature along said characteristic and to be not more than a predetermined highest concentration level; and recovering said solvent after condensation.

2. Method according to claim 1, wherein said characteristic is derived from the relationship between temperature and the increase in concentration per unit of time.

3. Method according to claim 1, wherein said concentration level of said solvent is controlled continuously in such a way that it remains restricted under all conditions to a maximum proportion of 75% of the lower explosive limit.

4. Method according to claim 1, wherein said drying said textiles using hot air takes place to a residual concentration level of between about 1 $g/m^3$ to about 2 $g/m^3$.

5. Method according to claim 1, further comprising the step of supplying heat intermittently when said predetermined highest concentration level is reached during an increase in concentration level.

6. Method according to claim 1, further comprising the step of heating a means for continuously measuring concentration level of said solvent to avoid condensation of said solvent.

7. Method according to claim 1, wherein said measurements are made directly in the flow of recirculated air.

8. Method according to claim 1, further comprising the step of using the ineteraction of temperature and concentration to arrive at a point where it is no longer worthwhile to feed in heat.

9. Method according to claim 1, further comprising the step of determining factors for a given machine and a given solvent which influence the drying and entering said determined factors into said computer as known curves to form a reference.

10. Method according to claim 1, further comprising the step of presetting a predetermined temperature, for the onset of the cool-down phase following the drying and when the temperature drops below this level there is an automatic changeover to the exhaust phase, unless a given concentration level has still not been reached.

11. Method according to claim 10, further comprising the step of delaying the changeover from the heating phase to the cool-down phase until the concentration has dropped to at least 90% below whatever is the figure for maximum concentration.

12. Method according to claim 1, further comprising the step of interrupting the supply of heat with any fault in the operation of the concentration measuring facilities.

13. Method according to claim 1, further comprising the step of creating preprogrammed signals used to control machine systems said machine systems being; supply of steam, fan motor, cylinder drive, door lock, exhaust flaps, fresh air flaps, valves and cooling systems.

14. Method according to claim 1, wherein said computer, sets an optimum drying and cool-down times as a function of the curve followed by the concentration of solvent in the cylinder.

15. Method according to claim 1, further comprising the step of making use of latent heat present in the cylinder, to obtain a further drop in concentration in the cool-down phase, cool-down being brought to an end and the venting process initiated once concentration has dropped to below a preset limit, and in particular a limit represented by about 10%.

16. Apparatus for cleaning textiles with a solvent comprising:

a washing and drying drum;

means for introducing said solvent into said washing and drying drum;

a heating system and means for supplying hot air for drying said textiles in said washing and drying drum;

a condenser for condensing said solvent during said drying of said textiles;

means for continuously measuring throughout the whole of said drying of said textiles, a concentration level of said solvent, said means for continuously measuring said concentration level, positioned at an exit from said washing and drying drum;

means for measuring continuously throughout the whole of said drying of said textiles, a temperature of said drying hot air, said means for measuring continuously said temperature, positioned at said exit from said washing and drying drum;

means for processing, in a programmable logic computer, said measured concentration level of said solvent and said measured temperature of said drying hot air, said programmable logic computer internal to said apparatus (PLC) to supply preprogrammed signals to act as control signals for the supply of heat;

means for continuously controlling throughout the whole of said drying of said textiles, based upon said computer processing of said measured concentration level and said measured temperature, said temperature level of said drying hot air, said continuous controlling being a function of a relationship between said concentration level, acting as a pilot value, and temperature along a characteristic and to be not more than a predetermined highest temperature;

means for controlling continuously throughout the whole of said drying of said textiles, based upon said computer processing of said measured concentration level and said measured temperature, said concentration level of said solvent, said controlling continuously being a function of said relationship between said concentration level, acting as said pilot value, and said temperature along said characteristic and to be not more than a predetermined highest concentration level; and means for recovering said solvent after condensation.

17. Apparatus according to claim 16, further comprising means for heating the measuring channel of the concentration measuring unit.

18. Apparatus according to claim 16, characterised in that the measuring channel of the concentration measuring unit is positioned directly in the flow of hot air at the exit from the drum.

19. Apparatus according to any of claim 16, characterised in that the control of drying is performed by a control of the fuzzy logic kind.

20. Apparatus according to claim 16, wherein said means for continuously measuring said concentration level of said solvent further comprising means for self-checking having self-check functions to check its operation automatically.

* * * * *